US008492629B2

(12) United States Patent
Johnson

(10) Patent No.: US 8,492,629 B2
(45) Date of Patent: Jul. 23, 2013

(54) SHOULDER REST

(75) Inventor: Kenneth Gordon Johnson, Shetland Islands (GB)

(73) Assignee: Pure Acoustic Ltd. (GB)

( * ) Notice: Subject to any disclaimer, the term of this patent is extended or adjusted under 35 U.S.C. 154(b) by 8 days.

(21) Appl. No.: 13/260,839

(22) PCT Filed: Mar. 19, 2010

(86) PCT No.: PCT/EP2010/001730

§ 371 (c)(1),
(2), (4) Date: Sep. 28, 2011

(87) PCT Pub. No.: WO2010/115512

PCT Pub. Date: Oct. 14, 2010

(65) Prior Publication Data

US 2012/0011982 A1 Jan. 19, 2012

(30) Foreign Application Priority Data

Apr. 1, 2009 (GB) ..... 0905547.6
Mar. 15, 2010 (GB) ..... 1004155.6

(51) Int. Cl.
*G10D 3/02* (2006.01)

(52) U.S. Cl.
USPC ..... 84/280

(58) Field of Classification Search
USPC ..... 84/280
See application file for complete search history.

(56) References Cited

U.S. PATENT DOCUMENTS

| | | | | | |
|---|---|---|---|---|---|
| 2,697,374 | A | * | 12/1954 | Ungh | 84/280 |
| 3,479,916 | A | * | 11/1969 | Wolf | 84/280 |
| 3,631,754 | A | * | 1/1972 | Kun | 84/280 |
| 4,333,378 | A | * | 6/1982 | Hrdlicka | 84/280 |
| 4,386,548 | A | * | 6/1983 | Wolf | 84/280 |
| 5,270,474 | A | * | 12/1993 | Kun | 84/280 |
| D406,269 | S | * | 3/1999 | Mach | D17/20 |
| 5,990,410 | A | * | 11/1999 | Johnson | 84/731 |
| 2012/0011982 | A1 | * | 1/2012 | Johnson | 84/280 |

FOREIGN PATENT DOCUMENTS

| | | | |
|---|---|---|---|
| DE | 29714325 | U | 1/1999 |
| GB | 798131 | A | 7/1958 |
| GB | 1160313 | A | 8/1969 |
| GB | 2444972 | A | 6/2008 |
| SE | 421843 | B | 2/1982 |

* cited by examiner

*Primary Examiner* — David Warren
*Assistant Examiner* — Robert W Horn
(74) *Attorney, Agent, or Firm* — Berliner & Associates

(57) ABSTRACT

A shoulder rest for a violin, viola or like instrument is described which has a reduced risk and incidence of slippage and disengagement from the instrument by having provided thereon a cross-member adjacent to or displaced from the rest member of the shoulder rest, which cross-member is resilient and substantially stretch resistant and preferably linking two support members protruding from or associated with the rest member of the shoulder rest. When pressure is applied during use, the legs (or support members) of the shoulder rest do not splay and the shoulder rest remains in position. Feet or gripping members for attaching a shoulder rest to a violin reduced any detrimental impact to the sound quality of the violin caused by use of a shoulder rest by maintaining contact with the backplate only in the area of the backplate outside the inner purfling line.

8 Claims, 7 Drawing Sheets

SHOULDER REST

FIELD OF THE INVENTION

The invention relates to a shoulder rest for use on a musical instrument, in particular a violin or viola or like instrument. In particular the invention relates to a shoulder rest, or an adaptive device for a shoulder rest, which reduces the likelihood of disengagement of the shoulder rest from the instrument during use, and to a method of making the same. Still further, the invention relates to gripping members or feet for a shoulder rest for minimizing contact with the instrument and minimizing the impact of a shoulder rest on sound quality.

BACKGROUND OF THE INVENTION

Violin players regularly use a shoulder rest to support the violin on the shoulder of the user during use of the violin. Shoulder rests are typically separate items which clamp to the rim of the violin. Ideally, contact with the body of the instrument should be minimised in order to not affect the sound.

While traditionalists may consider that a violin should be played without a shoulder rest, the technique of doing so is difficult and takes time and motivation to learn. Most violinists prefer to use a shoulder rest, even some of the great violinists.

One problem with using a shoulder rest is how to securely fix it to the violin whilst enabling comfort for the user and without having a detrimental effect on the sound produced by the violin. It generally understood that applying a pressure to the surfaces of the violin (e.g. by a clamping mechanism), especially the front but also the back surface, has a detrimental effect on the sound of the violin. The original shoulder rests involved a pad of some description arranged between the violinist's shoulder and the instrument, but this tends to have a muffling effect on the sound. This has a further problem that it may move during the performance. There have been numerous efforts to create and improve upon the violin shoulder rest. Several advantages that have been sought include the method of fixing (to avoid affecting the sound too seriously), adjustability of the shoulder rest so that it can be used according to the preference of the violinist, comfort, portability and rapid means for fixing and releasing.

U.S. Pat. No. 5,377,573 describes a shoulder pad for a violin having a foam pad with a pair of parallel longitudinal channels therethrough which passes an inelastic filament loop. One end of the filament loop is fitted around the end button on the instrument whilst an elastic band encircles the opposite end of the filament loop and is hooked over the lower bout corner on the bass-bar side of the instrument. This arrangement is said to minimize slippage of the pad on the back of the instrument.

GB-A-2426117 discloses a shoulder rest for a violin which consists of a shoulder pad with a single support arm mounted onto the violin via a mounting plate which is adapted to be clamped to the body of the instrument. Typically, the mounting plate is fixed to the violin by incorporating the mounting plate into the back side of the clamp by which a chin rest is held to the instrument. The shoulder rest described in GB-A-2426117 may be fitted to the violin by inserting the support arm into a socket in the mounting plate adapted to receive it. A disadvantage of this arrangement is that there is a significant amount of stress placed upon the support arm and on the mounting plate when in use, such that it is necessary to utilize heavier and more expensive materials in its manufacture and furthermore may be detrimental to the effectiveness and security of the chin rest clamp. In addition, the range of adjustment of the shoulder rest to suit the user is limited.

US-A-2006/0207405 describes a secure instrument support for a violin, having a shoulder rest and a chest support which may be separately and adjustably attached to a base, which is mounted on the back side of the instrument via three mounting members configured to engage the outside edges of the instrument at three different locations (e.g. at the lower side, the bottom and the waist regions of the instrument). According to the disclosure, this configuration allows the base to be securely fitted at the desired location and whereupon the shoulder rest and chest support may be fitted and adjusted, as may the orientation and angle of the base, according to the users preferred angle of holding the instrument and individual comfort whilst preventing slippage of the shoulder rest during performance. A disadvantage of this configuration is that it requires additional time to fit and adjust the device for the comfort of the individual user is not immediately removable and although significantly more secure may not cure the problem of disengagement of a shoulder rest during performance.

The now dominant primary design in violin shoulder rests is based upon the disclosure in U.S. Pat. No. 3,631,754 of a longitudinal support member mounted to the instrument via two adjustable clamping elements which engage with the sides of the instrument, a design that Kun adapted from earlier dual clamping longitudinal supports such as that of Ungh (U.S. Pat. No. 2,575,569) that were restrictive in their positioning and suitable for a single size of instrument.

U.S. Pat. No. 3,631,754 describes a shoulder rest for a violin having a longitudinal rest member, which is deformable to allow adjustment of its shape for the user's comfort, which has at the ends thereof two fork-shaped jaws for engagement with the side walls of the instrument. The position of the jaws is adjustable with regard to the rest member in upright and longitudinal directions to enable it to fit to different sizes of instrument and to be fitted at different points of the instrument to enable proper positioning. The jaws are fixed to the longitudinal rest member via terminal members which may be screwed to the longitudinal rest member at several different locations allowing adjustment of the length. The jaws are connected to the terminal members via rivets which allow the adjustment of tilt of the longitudinal rest member across its longitudinal axis.

Most of the improvements in this design of shoulder rest have focused on the adjustability of the rest. For example, U.S. Pat. No. 6,031,163 discloses a longitudinal rest member having two terminal clamping members having improved adjustability by way of fixing a foot member of each clamping member to the elongated base of the shoulder rest by a thumbscrew fitted through one of two or more openings in the foot member and received by one of two or more nuts embedded in the elongated base which respective openings and nuts are separated by different distances. By this means, at least four different clamping distances may be achieved with a minimum number of nuts and openings. In US-A-2005/0016355 there is described a steplessly adjustable shoulder rest. Each of two binding elements are connected to the end walls of two adjusting slides, which each have a horizontal main body provided with a long slot adapted to flatly and slidably locate in one of two oppositely spaced recesses formed in the elongated wooden base of the shoulder rest. At a predetermined position within each recess is provided a guiding and locking bolt which projects through the long slot of respective adjusting slide. The adjustable slides are held in place by two nuts fixed to the locking bolt and may be adjusted by loosening said nut and sliding the adjustable slides along the recess in the elongated base to the desired position.

One of the main problems associated with shoulder rests, including the dominant Kun design, has been that of slippage or disengagement of the rest during playing. When adjusted for a particular violinist's preference, there remains the risk during performance that the shoulder rest will slip into a different position or will fall off altogether. A further problem arises in traditional designs in that due to the propensity for slippage or disengagement, the gripping elements or feet are typically so large that they are thereby putting pressure on the main body of the violin backplate during use, which is detrimental to the vibration and thus sound performance of the instrument.

Problem to be Solved by the Invention

There remains a need for an improved shoulder rest, which provides comfort and support for the violinist whilst ensuring that the rest and its attributes remain throughout the violinist's performance.

It is an object of the invention to provide a shoulder rest that provides comfort and support when used by a violinist, may be securely fitted to a violin and in use has a reduced propensity to move relative to the violin or to disengage therefrom.

It is a further object of the invention to provide a device for fitting to existing shoulder rests of the bridge-type single member design in order to reduce the propensity of the shoulder rest to disengage from the violin during play.

It is a yet further object of the invention to provide a shoulder rest having gripping members or feet having minimal contact with the backplate of the instrument.

It is a still further object of the invention to provide a method of manufacturing such a shoulder rest.

SUMMARY OF THE INVENTION

In accordance with a first aspect of the invention, there is provided a shoulder rest for a violin or viola or like instrument said shoulder rest comprising a longitudinal rest member having a first surface adapted for resting against the shoulder of a user and a second surface on the opposing side of said rest member from the first surface and projecting from said second surface at positions separated along the longitudinal axis of said rest member first and second support members themselves attached to first and second gripping members for clamping said shoulder rest to a violin or viola or like instrument, the shoulder rest characterized in that a longitudinal cross-member is provided adjacent or displaced from the second surface of said rest member, which longitudinal cross-member is sufficiently stretch resistant in its longitudinal direction and attached to the rest member and/or support member in such an arrangement that on application of pressure to the first surface of the rest member splay of the gripping members is inhibited thereby reducing the likelihood or incidence of disengagement of the shoulder rest from the instrument.

In a second aspect of the invention, there is provided a splay reducing device for an instrument shoulder rest said shoulder rest comprising a longitudinal rest member having a first surface adapted for resting against the shoulder of a user and a second surface on the opposing side of said rest member to the first surface and two gripping members for clamping said shoulder rest to the instrument said gripping members positioned projected outwardly from the second surface at points separated along the longitudinal axis of said rest member, said device comprising a longitudinal cross member and securing means for securing to said shoulder rest, which device is releasably attachable to said shoulder rest between the gripping members and the rest member and which device is characterized by being substantially resistant to longitudinal stretch whereby it prevents release of the shoulder rest from the instrument when pressure is applied to the first surface.

In a third aspect of the invention, there is provided a method for manufacturing a shoulder rest or device as defined above, said method comprising the steps of providing tooling for producing said shoulder rest or device, such as preparing a mould of said device, providing such tooling with material for formation of the shoulder rest or device (such as molten plastic or polymer forming composition for a mould), finalizing said product (e.g. curing or setting said polymer) and finishing said product (e.g. by cutting, providing screw threads and providing gripping members for attachment to said shoulder element and optionally providing a pad for the first surface of the rest member and assembling the components).

In a fourth aspect of the invention, there is provided a shoulder rest for a violin or viola or like instrument said shoulder rest comprising a longitudinal rest member having a first surface adapted for resting against the shoulder of a user and a second surface on the opposing side of said rest member from the first surface, at least one support member projecting from said second surface and first and second gripping members for clamping said shoulder rest to a violin or viola or like instrument, the shoulder rest characterized in that a longitudinal cross-member is provided adjacent or displaced from the second surface of said rest member, which longitudinal cross-member is sufficiently stretch resistant in its longitudinal direction and attached to the rest member and/or support member in such an arrangement that on application of pressure to the first surface of the rest member splay of the gripping members is inhibited thereby reducing the likelihood or incidence of disengagement of the shoulder rest from the instrument.

In a fifth aspect of the invention, there is provided a gripping member for use in attaching a shoulder rest to a violin or like instrument having a backplate and a purfling formed therein, the gripping member being characterised in that, in use, it does not contact the portion of the backplate inside the purfling line.

In a sixth aspect of the invention there is provided an instrument gripping member for a shoulder rest for a viola, violin or like instrument, the gripping member comprising a body having a, typically planar, backplate engageable surface and one or more edge engagement appendage, (the gripping member preferably being such that when resiliently coupled with a further gripping member in suitable arrangement is capable of clamping to the instrument), characterized in that when an edge engagement appendage is fully engaged with the edging, the backplate engageable surface of the body extends no more than 6 mm from the outside edge of the instrument and/or extends no further from the outside edge of the instrument than the inner line of the purfling.

In a seventh aspect of the invention, there is provided a structural core element for use in manufacturing a gripping member for a violin shoulder rest for providing structural integrity thereto, the structural core element being a planar element having a threaded aperture formed therein for receipt of a threaded stem for fixing a gripping member to a shoulder rest, or having cast thereon a stem, characterized in that the planar width of the core element is no more than 6 mm.

In an eighth aspect of the invention, there is provided a shoulder rest for a violin having at least one gripping member as defined above.

ADVANTAGES OF THE INVENTION

The present invention provides improvements in shoulder rests, in particular the bridge-type shoulder rest of the prior art. The shoulder rest of the present invention reduces the extent of splay of the feet or gripping members on application of pressure to the surface of the shoulder rest when placed against the shoulder and thereby reduces the likelihood of the shoulder rest disengaging from an instrument to which it is attached during use. The invention further provides a more robust shoulder rest that is lighter than corresponding prior art examples and commercially available examples which is attractive to the user. Still, further, the shoulder rest of the invention is typically adjustable which allows different heights and orientation preferences in shoulder rests to be accommodated in a secure manner, and without increasing the extent of contact with the instrument and without detriment to the sound produced. Still further, the use of gripping members according to the present invention in a shoulder rest for a violin or viola reduce the contact with the area of the backplate inside the purfling and thereby minimizes any detriment to the sound produced by engagement of such a shoulder rest.

DETAILED DESCRIPTION OF THE INVENTION

Figure 1:
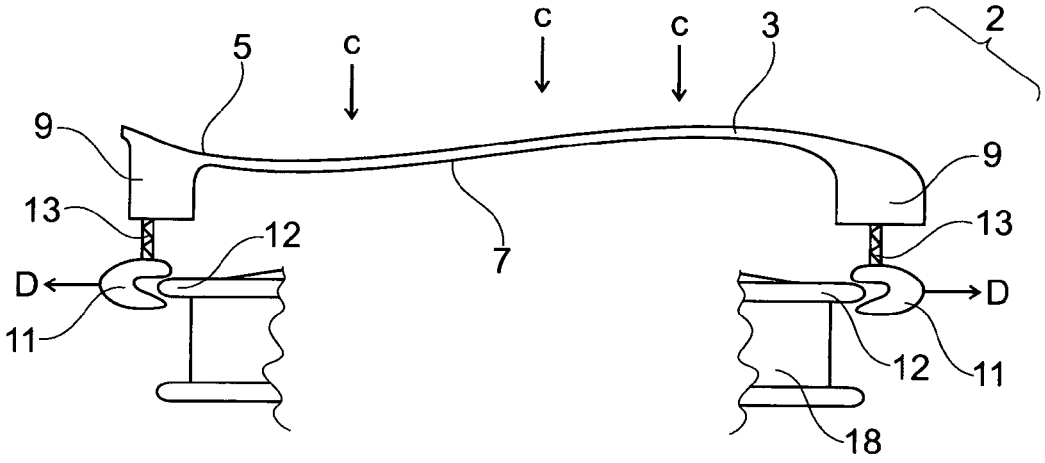
FIG. 1 is a side elevation of a conventional prior art single member or bridge-type shoulder rest.

The shoulder rest of the invention is in particular an improvement on the bridge-type or single-member form of shoulder rest, which typically comprise a longitudinal rest member adapted for contact with the shoulder of a user, support members (which may optionally be separate or integrated into the rest member) or legs protruding from the surface of the rest member facing the opposite direction to that intended for contact with the shoulder of the user and gripping members or feet for gripping the edge area or rim of the instrument in order to clamp the shoulder rest to the instrument. The inventive shoulder rest solves the problem of splay of gripping members and disengagement of the shoulder rest during use. In a further aspect of the invention a splay reducing device is provided, which is adapted for use in connection with prior art and commercially available shoulder rests in order to reduce shoulder rest disengagement. A still further aspect provides for novel gripping members for use with a shoulder rest demonstrating minimal splay, the gripping members being characterized in that, in use, the area of the gripping member in contact with the backplate does not protrude inside the purfling line of the instrument.

The shoulder rest of the invention is intended for use with violins, violas and like instruments and comprises a longitudinal rest member which has a first surface adapted for contact with the shoulder of the user and a second surface on the other side of the longitudinal rest member facing substantially the opposing direction to the first surface. Protruding from the second surface at positions separated along the longitudinal axis of the rest member are first and second support members (or legs). These support members may be positioned at any points on the rest member but preferably toward opposing ends of the rest member. The support members are typically attached to instrument attachment means, or first and second gripping members (or feet). The support members and gripping members are so arranged on the rest member so that they may be secured to the reverse of an instrument such as a violin or viola in order to support the instrument comfortably on the user's shoulder. The shoulder rest of the invention is characterized by a longitudinal cross-member which is adjacent to or displaced from the second surface of the rest member and attached to the shoulder rest in such an arrangement that, on application of pressure to the first surface of the rest member, splay of the gripping members is inhibited thereby reducing the likelihood or incidence of disengagement of the shoulder rest from the instrument.

Preferably, the shoulder rest of the present invention is attached or attachable to a violin, viola or other like instrument only by the gripping members (preferably only by two gripping members) and preferably it attached or attachable only to the rim or edge region of the instrument (ideally only contacting the backplate of an instrument outside the inner purfling line or within a 6 mm distance from the edge of the instrument). Preferably and ideally, the shoulder rest according to the invention and as described herein is not mounted on the violin (or like instrument) as an attachment to a chin rest or supported by a chin rest or mounting on the end button of the instrument.

The shoulder rest member is typically of a length of an order similar to that of the width of the instrument to which it is to be attached, e.g. violin or viola. Its width may be any suitable width for comfortable use and is typically in the region of 2 to 5 cm for a violin.

Optionally, there are provided in the shoulder rest height adjustment means, which may be independently operated so that the height of the rest may be adjusted to suit the comfort of an individual user. The height adjustment means may typically be formed in a fixing between the gripping members and the support members, such as by way of a screw thread, for example, or any other suitable such height adjustment means as is known in the art. Alternatively, the height adjustment means may be formed as part of the support members.

According to one aspect, the cross-member is adjacent the second surface of the rest member. In one embodiment, the cross-member is laminated, or partially laminated, to the second surface of rest-member. It is necessary according to this embodiment, for the cross-member to be substantially rigid and resistant to stretch and bend motions and in any case significantly more rigid than the rest member. Where the cross-member and the rest member are formed of the same material, it is necessary in order to establish the additional rigidity and resistance to stretch for the cross-member to be laminated to the rest member whilst the cross-member is under tension, or pre-tensioned. The pre-tensioned laminate cross-member may be fixed to the second surface of the rest member by any suitable means, which may include screw fixings or other mechanical fixing or suitable adhesive for the material used. The cross-member may be laminated along the full length of the rest member or a portion thereof, which is preferably a central portion and which portion is a major portion that is preferably at least half the distance between support members, more preferably at least three-quarters of the length between support members and most preferably at least 90% of the distance between support members. The cross-member should be laminated to the rest member pre-tensioned sufficiently that the resulting shoulder rest gripping member total splay is diminished on application of pressure during play to 3 mm or less, preferably 2 mm or less, still more preferably 1 mm or less and most preferably is entirely diminished.

Preferably according to this aspect of the invention the rest member and cross-member are formed of wood or wood products and preferably the lamination is formed with a suitable wood adhesive.

According to another aspect, the cross-member is displaced from the second surface.

In one embodiment according to this aspect of the invention, the cross-member is attached to the second surface of the rest member to form an undercarriage. In this embodiment, the cross-member is attached to the second surface of the rest member via two undercarriage supports which protrude from the second surface of the rest member at positions longitudinally separated along the longitudinal axis of the rest member, optionally at positions different to the support members and at either side of a central point located equidistant from each of the support members. Optionally, however, the cross-member forming the undercarriage may be supported by a first undercarriage support and a second undercarriage support, either or both of which act also as support members. Preferably, each undercarriage support protrudes from the second surface at a position at least half the distance from the centre point as does the respective support member, preferably between 60 and 90% of the distance and more preferably about 75% of the distance or more. Preferably, the undercarriage supports are attached at each end or end portion of the cross member. The cross-member may be of any suitable configuration and may, for example, be a substantially planar or curved, but of flat cross section, element. In this case, the undercarriage supports may be laterally extending to the extent of the cross-member width. Alternatively, there may be provided two or more wire-like cross-members each having a wire-like undercarriage support or both connected to a single laterally extended undercarriage support. Such wire-like cross members may be tubular elements or solid core metal, plastic, wooden or composite members. Optionally, the rest member, undercarriage supports and cross-member(s) form separate parts attached together using separate fixings or two or more parts may be integrally formed (e.g. molded). The rest member, undercarriage supports and cross-member(s) preferably form a skewed box section or may form a curved or skewed semi-circular shape. The materials used for the undercarriage supports and cross-member may have some flexibility but are preferably largely resistant to stretch and in any case, the box-section as a whole is preferably of sufficient rigidity such that on application of pressure to the first surface of the rest member, the gripping members are inhibited from splaying.

A better splay reduction effect is seen the closer to the points of protrusion of the support members the undercarriage supports carrying the cross-member are fixed.

In another and preferred embodiment according to this aspect of the invention, the cross-member is attached between the gripping members and the rest member. The cross-member may be attached between the gripping members and the support members, in which the extremities of the cross-member form part of the support member.

The cross-member may be attached to the support member at any position from the junction of the support members and the rest member to the junction of the support member and the gripping members.

It is believed that the splay reduction effect is greater the closer to the gripping members the cross-member is attached, although this has to be balanced with the avoiding contact of the cross member with the instrument. Accordingly, the closer to the rest member the cross-member is positioned the greater resistance to stretch that is required. However, the closer to the gripping members the cross-member is located, the more risk there is of there being contact with the instrument, which may have a detrimental impact on the sound, such as muffling.

The cross-member should be sufficiently stretch resistant in its longitudinal direction that splay of said gripping members on application of pressure to the first surface of the rest member is minimized to the extent that shoulder rest does not fall off the instrument. Accordingly it is preferred that the cross member is substantially stretch resistant in the longitudinal direction.

The longitudinal cross-member according to this embodiment may be formed of the same or different material to the rest member and may be for example metallic, composite or stretch-resistant textile wire, a woven or non-woven fabric or textile (such as nylon or Kevlar), a plastic/polymer material, wood or wood product, composite material, composite polymer material, or stretch resistant metal, alloy or ceramic material. Preferably, the longitudinal cross-member is formed of a wood, composite (e.g. glass filled Nylon) or plastic (e.g. high density polyethylene) material.

The longitudinal cross-member preferably has a Young's modulus or tensile elasticity in the longitudinal direction of greater than 0.1, preferably from 0.2 to 200, more preferably from 1 to 100, still more preferably 2 to 25 and most preferably from 5 to 10 and any case preferably greater than 5.

The arrangement of longitudinal cross-member with respect to the other elements of the shoulder rest and the materials utilized in its manufacture should preferably be such as to minimize the extent of splay to 4 mm or less, more preferably 2 mm or less, still more preferably 1 mm or less and most preferably to substantially no splay, on application of pressure typically incurring during play to the first surface of the rest member. Alternatively, the splay of the gripping members may be expressed as a percentage separation of gripping members on application of pressure and for a gripping member separation of up to 300 mm, the degree of splay is preferably 1.5% or less, more preferably 1% or less and still more preferably 0.5% or less. Optionally, according to the arrangement of the device, pressure applied to the first surface of the rest member may cause the gripping members to tend toward one another or grip harder, but preferably the extent of splay and the extent of additional grip is substantially zero in order to minimize risk of disengagement whilst minimizing impact on instrument acoustics.

The material used in the cross-member is preferably characterized by low or zero creep, especially in the longitudinal direction.

Without being bound by theory it is believed the benefit of reduced splay by incorporating a cross-member into the bridge-type shoulder rest may be achieved by shifting the point of pivot when the gripping members are each applied with a force in an outward direction. The conventional bridge-type shoulder rest has a point of pivot at substantially the mid-point of the rest member between the points of protrusion of the two support members. The pivot point is therefore a substantial distance from the gripping members which means that the leverage potential is large. By providing a cross-member according to the present invention, it is believed the pivot point is shifted. For example where the cross member is attached at the mid-point between the gripping means and the rest member, it is believed that the pivot point is shifted to close to the fixing point of the cross-member leaving little scope for leverage and thus reduced splay.

The cross member is preferably slightly curved in shape such that the central portion is positioned further away from the instrument so that contact with the back of the instrument, when the rest is in use, is avoided.

In one embodiment, the rest member and cross-member are formed as a single moulded piece (e.g. of plastic) which incorporates the support member. Height adjustable gripping members may be fitted to the support members.

In another embodiment, the rest member and cross-member are detachable from one another, that is they are detachably attached, e.g. through a push-fit fixing or other such fixing. For example, the support members and the cross-member may be formed in a single moulded component which push fits to the rest member. Optionally spacer members may be fitted between the integrated cross-member and support member element and the rest member. Such spacer members may provide a height adjustment capability such that major height adjustment can result in an increase in separation between the rest member and the cross-member, which it is believed improves the splay resistant performance, rather than between the cross-member and the gripping members (e.g. by adjusting a screw thread connector between the gripping members and the support members). Such spacer members may be provided in an array of sizes, such as 2 mm, 5 mm, 10 mm, 15 mm and 20 mm and/or combinations thereof, so that a range of height adjustments may be provided for and so that each side may be adjusted to a different height. Fine tuning of height adjustment may still be provided (e.g. by a screw-fix adjustable gripping member).

Optionally, height adjustment may be provided by a screw element intermediate the cross member and the rest member.

The gripping means may be adjusted to fit the instrument being used and for comfort and size preferences, by any suitable means known in the art. Optionally, a range of ports are provided in the support members for receiving a fixing means for the gripping members. For example, gripping members may be attached to the support members by screw fixings in receiving threads formed in pivotable (by means of a hinge) brackets formed on the support members whereby the screw fixings are adjustable from a upright gripping configuration to a fold together store configuration. An example of such a fixing is described in US-A-2008/0196570.

The rest member used for contact with the shoulder should preferably be self supporting by which it is meant it is capable of retaining its shape and more preferably substantially rigid. Optionally, the rest member is made of a material (e.g. of an aluminium core optionally coated with a malleable plastic) whereby it can be shaped to fit a user's shoulder for greatest comfort.

Preferably, the rest member is resilient and preferably substantially rigid, in that it retains its shape and is not susceptible to significant longitudinal stretch but may be capable of being flexed in other dimensions.

The rest member (defined for a right handed player) may be defined as having a distal edge, defined as the edge further from the user's neck when the shoulder rest is in position on the user's shoulder, and a proximal edge, defined as the edge nearest the user's neck in such a scenario. The ends of the rest member may be referred to as the head end (the end which rests upon the shoulder) and the chest end (which is toward the chest of the user).

The shape of the rest member may be flat (and adapted for use by optionally applying a foam or leather or other cushioning material) or may be configured to allow for comfort to a user's shoulder. Typically, therefore, the rest member may have a profile which, when viewing the distal edge with the first surface upwards has a concave to convex profile left to right, or in other words, the first surface is concave toward the head end (for comfortable fit on the shoulder of the user) and convex toward the chest end (to allow support of the device from the chest area). When viewed in plan (toward the first surface facing up) with the distal edge at the bottom of the plan and the proximal edge at the top, the rest member may, for example, optionally form a curved shape (i.e. a continual concave distal edge) or a double curved shape (i.e. a concave distal edge toward the head end and a convex distal edge toward the chest end) such that the shoulder rest fits comfortably on the shoulder but is configured to fit about the shoulder bone.

The cross-member may be of any suitable shape and may be substantially straight or planar (especially if, for example, the cross-member is a non-rigid material under tension, such as fabric, wire or cord). Preferably, the cross-member is curved toward the rest member. This has the benefit of ensuring that the cross-member avoids contact with the back of the instrument (which may affect tonal quality) whilst it may also have the benefit of causing under application of pressure to the first surface the gripping members to be drawn slightly together.

The cross-member is preferably kept slim in order to minimize weight of the shoulder rest. By having a box-section type shoulder rest (whether one piece or multi-piece rest element) comprising the rest member, cross-member and support members, the amount of material necessary for making both the rest member and the cross-member may be substantially reduced. Preferably, the cross member is narrow in the middle and wider at the ends.

The shoulder rest may be of any suitable shape that achieves the object of the invention described.

In the two embodiments described above in which the cross-member is formed displaced from the second surface of the rest member and in which preferred embodiments the rest member, support members and cross-member form respectively a single piece (e.g. moulded or fixed) rest element or a detachable version in which the rest member and/or the support members may be detached from the cross-member, it is preferred that the distance between the rest member and the cross-member (which may vary along its length) is suitable for and adapted for a range of requirements and may be for example a minimum of 2 mm apart to a maximum of 50 mm apart, more preferably 5 mm to 25 mm. Preferably in the embodiment of the invention with a one-piece rest element, the distance between the rest member and cross-member may range from 2 mm to 25 mm.

In one particularly preferred embodiment in which the rest member, support members and cross member form a one-piece rest element, it is preferred that there is a curved or double curved rest member and a concave cross-member forming the rest element. Such rest element may have a varied distance between the rest member and cross member along the longitudinal axis. Preferably, the maximum distance is in the range 5 mm to 30 mm to provide for shorter and longer necked players and for individual preference. Preferably the maximum distance is in the range 7 to 25 mm, more preferably 10 to 15 mm.

In a particularly preferred configuration of double curved rest member and concave cross-member, there is a chest end maximum distance (between rest and cross members), a minimum distance and a head end maximum, which are preferably in the range 5-10 mm, 1-5 mm and 5-15 mm respectively and optionally a further 10 mm in each case.

In the embodiment of the invention in which the rest member and cross-member may be detached, the members may be detached entirely to form two or more pieces or detached tied to form detached members which are still joined together in some way. For example, according to the detached tied embodiment, the rest member and cross-member may be separated but tied by means of a hinge member which may allow end-way hinging of the shoulder rest or edge-way hinging of the shoulder rest. Optionally, by having a hinged device, the shoulder rest may be folded flat for storage and in this case is preferably comprising a form of bracket or gripping member connection that enables the gripping members to be folded flat for storage. In one embodiment, however, the rest member and cross-member may be detached entirely. The shapes and sizes of rest member and cross member are preferably substantially as defined in connection with the one-piece embodiment. It should be noted however that the unextended (i.e. without spacer elements) size may be selected as required, and typically quite low, and extended with spacer elements according to requirements. Preferably, the unextended size of the distance between the rest member and cross member has a maximum in the range 5-20 mm.

The cross member as mentioned above may be narrow across its length and especially toward its central point. Preferably, the cross-member is narrower at the centre point than the rest member, preferably half the width or less and more preferably one third the width or less.

The support members are preferably provided with receiving threads or other similar connecting components for connecting with the gripping elements (which are preferably of a type well known in the art comprising screw thread attachments). Such receiving threads may be provided in plurality to allow some adjustment of positioning by selecting preferred receiving threads arranged laterally and longitudinally and for fitting the shoulder rest to different sized instruments.

With regard to the splay reducing device (which comprises a cross member that is preferably rigid) which may be fitted to existing bridge-type shoulder rests to reduce splay and rest disengagement, the securing means which when fitted may form a part of a support member, is preferably configured to be attach to the shoulder rest between the gripping members and the rest member. For example, if the shoulder rest comprises rest member and gripping members with a screw fix, the splay reducing device preferably comprises the cross-member and the securing means which may be a threaded hole for the passage of the gripping member's screw thread into the support member or rest member of the shoulder rest, thereby securing the cross-member in position. Preferably the cross-member is curved (as with the integrated version) to avoid contact with it and the back of the instrument. If some alternative form of bracket is provided as the support member, the cross-member may optionally be fixed between the gripping members and the bracket or to the bracket or between the bracket and the rest member. The splay reducing device may further comprise features of the cross-member and means of attachment described in relation to the cross-member of the shoulder rest invention herein where the context allows.

The support element, in the multi-piece embodiment, may form a single piece with the rest member or may form a single piece with the gripping means or may be formed of pieces of each. Optionally, the support member is the screw element for fixing a gripping member to a rest member.

In another aspect of the invention is provided a novel gripping member or foot for use in attaching a shoulder rest to a violin or like instrument, the gripping member or foot being characterised in that, in use, it does not contact the backplate inside the purfling line (or inside a distance up to 6 mm from the edge of the backplate). (The area of a backplate inside the inner purfling line may be described as the sound-critical backplate area, which may alternatively be described as the area of the backplate inside the lining).

The purfling in a violin is typically an inlaid laminate (typically three piece laminate) strip of wood designed to reinforce the backplate and prevent cracking along its edges. The upper (visible) layer of purfling is typically created in a decorative manner. The purfling is located in the backplate as a strip around the edge of the backplate of an instrument and is typically co-incident with the lining of the instrument (the lining being a strip of wood, typically, inside the instrument bonded to both the backplate and the side of the instrument in order to increase its strength and structural integrity). Typically, on a full-size violin, the lining will have a depth of about 5 mm and be about 2-3 mm wide (i.e. distance from violin side inwards), usually 2 mm. The purfling is typically 1-3 mm wide (usually 1-1.5 mm wide) and generally co-incident with the lining and laid in a channel in the backplate. Normally, for example, the purfling is about the width or slightly narrower than the lining such that the inner purfling line is in line with the inner edge of the lining. The outside edge (or outer line) of the purfling is typically in line with or slightly inside (e.g. by 0.5-1 mm) the inside edge or centre of where the side (rib) of the instrument abuts the backplate. Generally, the edge overhang of the backplate (i.e. overhanging the rib) is about 2.5 mm, the rib is about 1.25 mm thick (wide), and the lining is about 2 mm wide. Thus the distance from the edge to inner edge of the lining (and inside line of the purfling) is typically 5-6 mm.

A problem with the feet or gripping members of shoulder rests in the prior art is that contact is made with the backplate in the area inside the purfling line which can have an effect on the quality of sound produced by the instrument.

The edge portion as referred to herein is that portion of the backplate of a violin or like instrument that overhangs the outside face of the side (or rib) of a violin and/or the extreme edge of the backplate.

The novel gripping member in accordance with this aspect of the present invention preferably comprises a backplate engagement portion and an edge engagement portion and is characterized in that the backplate engagement portion abuts the backplate only in a region outside the inner purfling line and/or does not abut the backplate inside the inner purfling line.

Figure 7:
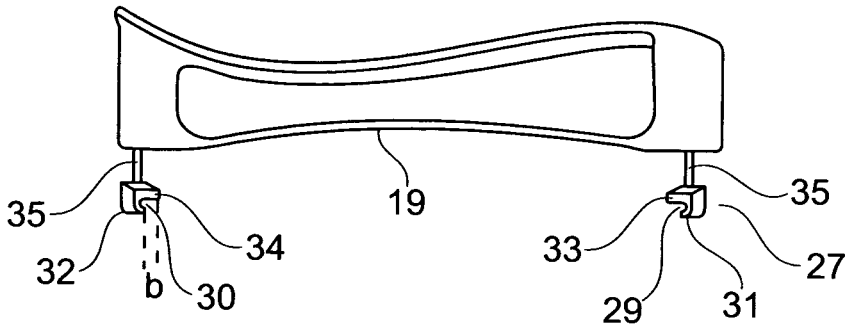
FIG. 7 shows a side elevation of the shoulder rest and gripping members of FIG. 6.

In a preferred embodiment, the gripping member in profile (e.g. as shown in FIG. 7) has a hook shape in which the shank portion of the hook forms the backplate contacting portion of the gripping member and the inside surface of the shank member comprises a backplate contacting surfaces, which is optionally flat, ridged or of other suitable configuration. The edge engagement portion according to this embodiment is formed by the curved and front members of the hook whereby the edge portion will be engaged with in the gape of the hook.

Preferably, the hook shape is laterally extended such that the gape is a channel or groove in a laterally extended gripping element. The gripping member may have one or more edge engagement appendages protruding from the backplate engagement portion, but preferably a single edge engagement portion. Preferably, the gripping member has a backplate contacting surface which extends no more than 6 mm from the ultimate edge contacting point of the groove or channel (of the edge-engagement portion) and more preferably no more than 5 mm.

Figure 6:
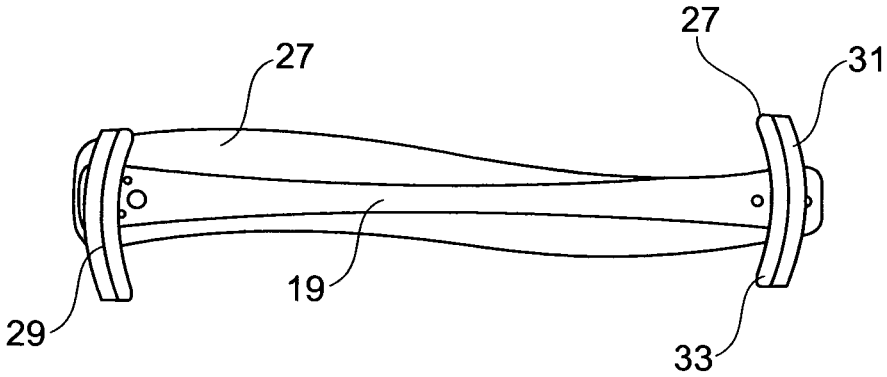
FIG. 6 shows a bottom elevation of a shoulder rest and gripping members according to a preferred embodiment of the invention.

Preferably, the gripping member has a curved configuration (when viewed from above or below, e.g. as shown in FIG. 6) such that the outside edge of the gripping member and the channel are curved slightly for engagement with the curved edge of a violin. Preferably, the width of the backplate contacting surface (i.e. from edge of instrument contacting surface inwards) varies by no more than 1 to 2 mm along its length (e.g. at points ¼, ½ and ¾ along its length), more preferably no more than 0.5 mm and most preferably is substantially constant. The curve of the gripping members (e.g. the edge engaging channel or groove) may preferably be described as an arc, e.g. subtending an angle of from 15-60°, preferably 30-45° of a circle of radius preferably 3 to 20 cm, more preferably 5 to 8 cm. Preferably, the curve (and body of the gripping member) has a length of 3 to 5 cm, more preferably 3.5 to 4.5 cm (e.g. about 4 cm).

There is further provided, therefore, in a yet further aspect of the invention a shoulder rest for a violin having one or more (preferably two) gripping members as defined above.

The shoulder rest according to this aspect is preferably comprised of a rest member such as that defined above and two support members protruding from the rest member. Optionally, and preferably, the shoulder rest has a cross member as described above for minimizing splay (e.g. by forming a box section with the rest member and support members).

The novel gripping means defined herein may be connected to or fixed to the support members (or even to the cross member) by any suitable means. In one typical embodiment, the gripping members are connected to the support members by means of stems. A stem may be detachable from the body of the gripping member (e.g. by an attachment means on the body or within the body of the gripping member), but is preferably manufactured as part of the gripping member and preferably comprises a threaded portion for receipt by a stem-receiving means in the support member.

A degree of height adjustment of the shoulder rest may be achieved by screwing the threaded stem into the thread-receiving means of the support member by varying amounts.

The gripping member is formed from any suitable material. Preferably, the gripping member comprises a rigid core element which provides strength, substance and structural integrity to the gripping element. This rigid or structural core typically forms an interior portion of the body of the gripping element, typically the backplate contacting portion of the body.

The structural core may typically have formed about it a resilient and/or flexible material forming a coating about the structural core and the edge engagement portion. Preferably, the resilient and/or flexible material forms the body of the gripping member about the structural core in a moulding process.

The structural core may be of any suitable material, e.g. rigid plastics, metals or composite material (e.g. glass fibre or carbon fibre composite), but is preferably a rigid metal such as steel, titanium or brass or the like, but preferably brass.

The body material (i.e. the resilient and/or flexible material forming the body by coating or moulding about the structural core) may be typically of rubber (natural or synthetic), plastic or composite material and should be self supporting (i.e. capable of retaining its shape). Preferably the body material is formed of a solid or foamed/porous polymer-based material and optionally may be natural or synthetic rubber, e.g. a latex rubber, an olefin polymer such as polypropylene or ethylene polymer (e.g. LDPE, LLDPE, HDPE), a polyurethane, ethylene/vinyl acetate copolymer, or a silicone rubber.

The structural core is preferably a rigid, planar element. Optionally, the core has an aperture in its receiving surface, which aperture is optionally threaded, in order to receive a stem or other connection for attaching the gripping member to the support member. Alternatively, the core may be formed with an integrated stem protruding therefrom. In either case, this removes the need for a structural core to be fitted with an insert (e.g. a plastic insert) into an aperture in the core for receiving a threaded stem and consequently the core of the present embodiment can be of reduced (planar) width (as compared with prior art). This is of great importance in maintaining a gripping member with minimal contact with the backplate.

Preferably, in order to maintain a lightweight core, the core has formed in its plane dimples or apertures to reduce the amount of material used whilst maintaining its structural integrity. These weight-reducing apertures are preferably circular and ideally are distanced from other apertures and the edges of the core by a distance of from 0.5 r (radius of aperture) to 2 r.

The structural core preferably has a curve along its length to correspond with the desired curve of the gripping member, so that the element is a curved planar element.

In order to minimize the width of the gripping element and in particular the backplate contacting portion, it is preferred that the core is up to 6 mm wide (at its widest point, e.g. at the position at which a stem protrudes or may be received) and preferably less than 6 mm (e.g. up to 5 mm) and still more preferably up to 4.5 mm. Typically, a stem for use in connecting the gripping element to the support members will have a thread of 3-4 mm in diameter requiring (if threaded to an aperture in the core) a receiving thread of 3-4 mm. To retain structural integrity, the core should comprise at least 1 mm each side of the aperture.

The length of the core element is preferably 1.5 cm to 5 cm, preferably 2-4 cm.

It is preferred that the means for connecting the gripping members to the support members, e.g. stems, are attached to the gripping members in an area corresponding to that outside the inner purfling line of a violin, when in situ. Accordingly, when pressure is applied to the rest member, there is no pressure on parts of the body of the gripping member not intended to touch the backplate that would cause it to deform and touch the backplate. By providing a splay reducing cross-member to the shoulder rest, smaller gripping members can be used that do not contact and/or do not risk contact with the sound-critical area of the backplate inside the purfling line.

In a preferred embodiment of the invention described above, a shoulder rest is formed with a cross-member forming a box section with the rest member and support members and is provided (e.g. via threaded stems) with at least two gripping members that do not contact the backplate inside the purfling and optionally having a structural core as described above.

The invention will now be described, without limitation as to the scope of the invention, with reference to the attached figures.

Figure 2:
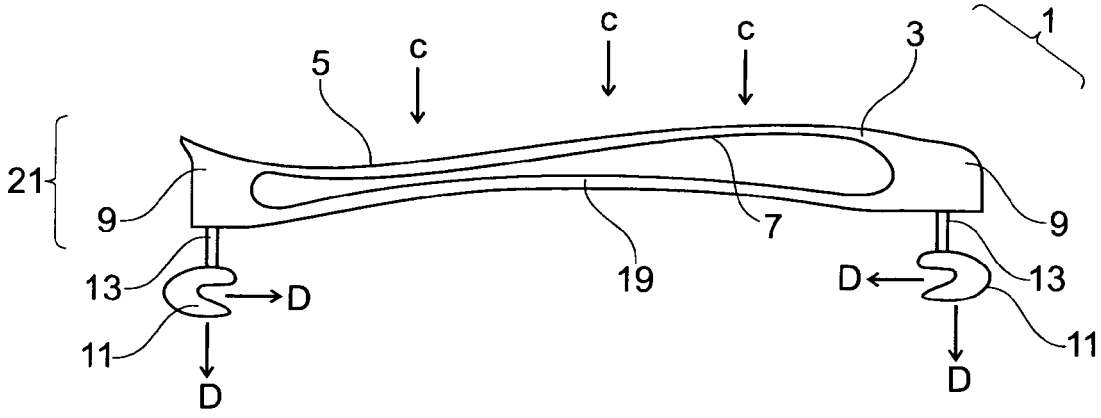
FIG. 2 is a side elevation of a shoulder rest according to one embodiment of the present invention.

With reference to FIGS. 1 and 2, a violin shoulder rest of the prior art 2 and of the invention 1 comprises a longitudinal rest member 3 having a first surface 5 for contact with a user's shoulder and a second surface 7. Projecting from the second surface 7 are two support members 9 which are themselves attached to gripping members or feet 11 for attaching the shoulder rest to the rim 12 of a violin 18. The gripping members 11 are attached to the support members 9 through a screw fixing 13 to receiving threads 15.

The conventional prior art shoulder rest 2, shown in FIG. 1, suffers from a disadvantage discussed herein that on application of pressure to the first surface 5 in direction C, the shoulder rest 2 is caused to flex forcing gripping members 11 to splay in direction D thus loosening the grip of the gripping members 11 on the rim 12 of said violin 18.

The shoulder rest 1 of the invention, shown in one embodiment in FIG. 2, has a cross-member 19 which bridges the two support members 9 to form a one-piece box section shoulder rest element 21 comprising the rest member 3, support members 11 and cross-member 19. On application of pressure in direction C to the shoulder rest 1 of FIG. 2, such as might be applied by to the rest by a shoulder during use, there is no splay of the gripping members. Instead on application of pressure to the shoulder rest member 3, this pressure is absorbed by the rest member/cross member configuration itself or is translated to light downward pressure and depending on the precise configuration of the cross member 19 in the shoulder rest, slight movement together of the gripping members of feet 11 allowing light gripping of the edge of the instrument when the player is applying more pressure on the shoulder rest 1. The cross-member 19 resists movement of the support members 9 and thus prevents splay of the gripping members 11 and prevents the shoulder rest from disengaging from the violin.

Figure 3:
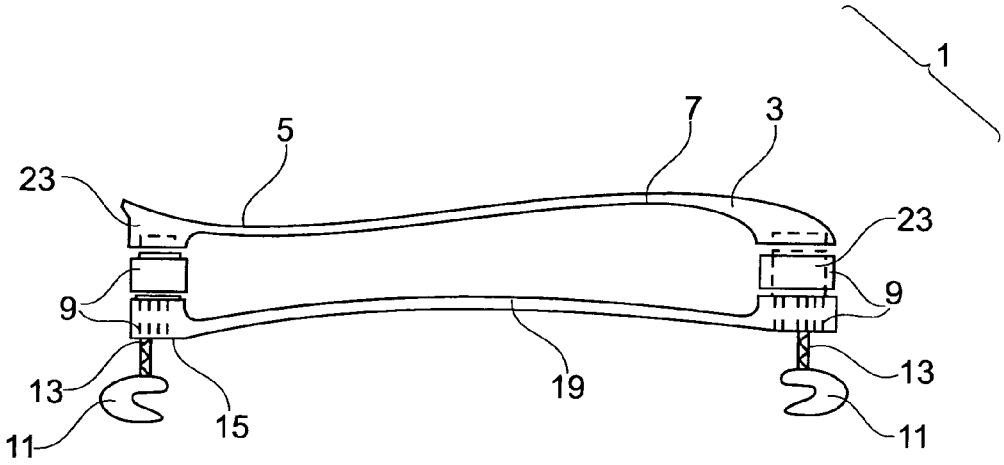
FIG. 3 is an exploded side elevation of a shoulder rest according to a second embodiment of the present invention having height adjustment blocks.

In the embodiment of the invention shown in FIG. 3, rest member 3 is removably attached to the support member 9 by a push-fit fixing or similar. The cross-member 19 is integrally formed with at least a portion of the support element 9. The support element 9 optionally includes a height-adjustment element 23 which enables the user to adjust the height of the shoulder rest according to their preference, whist keeping the screw fixing 13 position short so as to maximize the splay-inhibiting effect of the cross member. The height-adjustment elements 23 enable the user increase or decrease the height of the shoulder rest according to their comfort, in pre-determined steps according to the size of the height-adjustment element. Fine tuning of height preference may be achieved by adjusting the height of the gripping members 11 using adjustable screw fixings 13. The detachable nature of the rest member 3 and cross-member 19 allow for the device to be disassembled for convenient storage.

Figure 4:
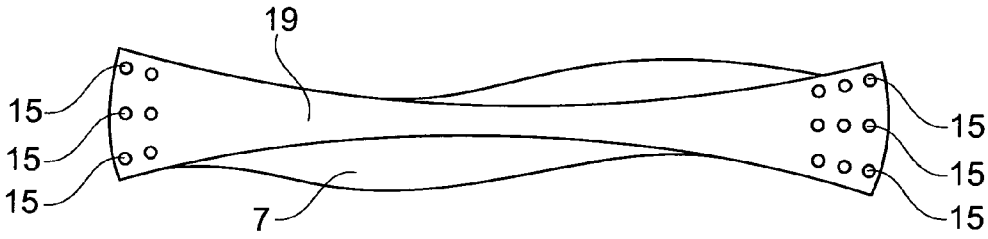
FIG. 4 shows a bottom elevation of the shoulder rest of FIG. 3 absent gripping members.
Figure 5:
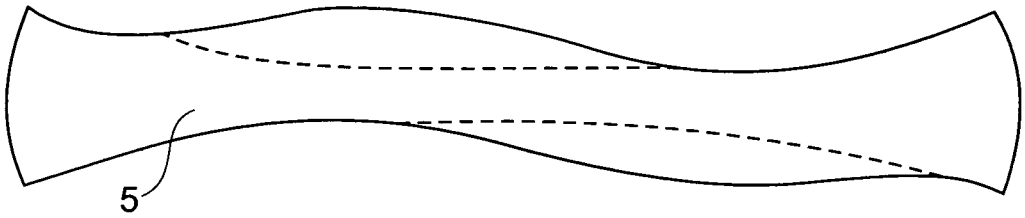
FIG. 5 shows a top elevation of a shoulder rest of an embodiment of the invention shown in FIG. 2 or FIG. 3.
Figure 9:
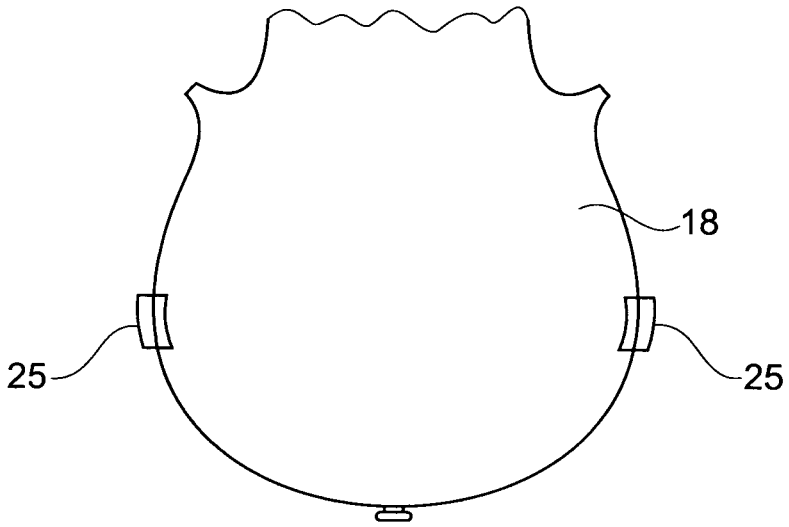
FIG. 9 shows the optimum gripping positions for a shoulder rest on a violin or viola.

As shown in FIG. 4, the cross-member of the shoulder rest of FIG. 3 may be provided on its instrument side with multiple receiving threads 15 for varying the positioning of the gripping members 11 according to the fit of the shoulder rest to the violin (e.g. for fitting to different sizes of violin) and the preference of comfort and fit of the shoulder rest on the shoulder of the user whilst maintaining optimum position 25 (see FIG. 9) for gripping members 11 in order to fit the shoulder rest to the violin.

In FIG. 6, a bottom elevation shows gripping member 27 of a laterally extended and narrow configuration and the curvature thereof. A channel 29 is defined between an edge engaging portion 31 and backplate engaging portion 33. A profile of the gripping member 27 is shown in the side elevation of FIG. 7. As can be seen, the profile can be described as having a hook shape in which the gape 30 formed between the front member 32 (i.e. edge engaging portion 31) and the shank member 34 (i.e. backplate engaging portion 33) forms a channel 29 in the laterally extended gripping member 27. Dimension b represents the maximum distance from the edge of the violin that the gripping member makes contact with the backplate of an instrument and this is preferably 6 mm or less.

Stems 35 are preferably attached to the body 37 of the gripping member 27 at a point above the backplate-contacting surface 39 (shown in FIG. 8), the backplate contacting surface 39 being designed not to contact the backplate inside the purfling line (shown in FIG. 10) and thus pressure applied to the gripping member 27 through the stem 35 will not cause additional contact with the backplate or cause additional movement.

Figure 10:
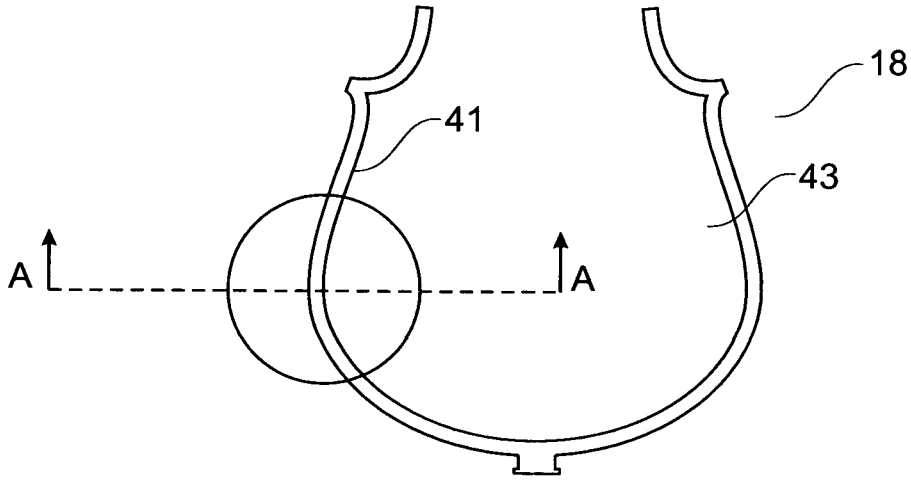
FIG. 10 is an illustration of the backplate of a violin showing the purfling line.
Figure 11:
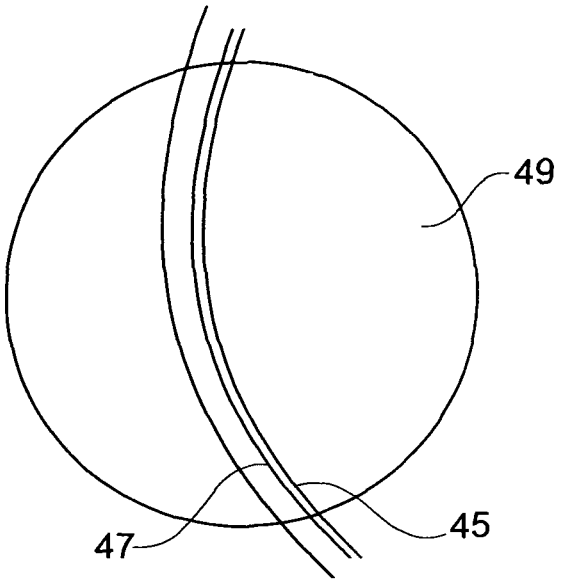
FIG. 11 is a magnified view of a portion of FIG. 10.
Figure 12:
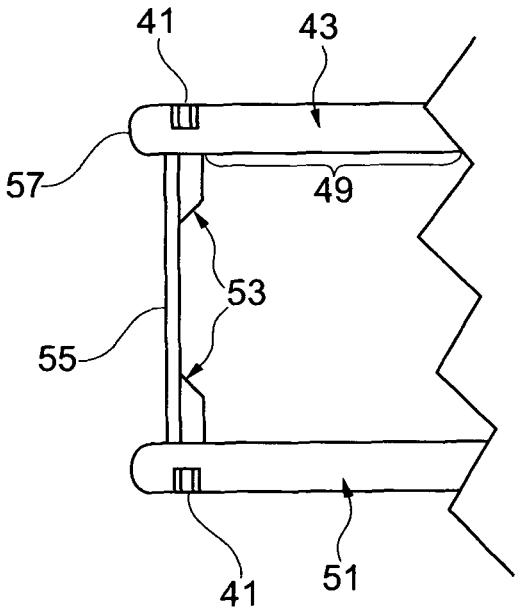
FIG. 12 is a cross-sectional view of the portion of FIG. 10.

In FIG. 10, the purfling 41 is illustrated on the backplate 43 of a violin 18. As mentioned above, the purfling 41 is an inlaid laminate material (wood) in a channel formed in the backplate 43 of a violin 18 to increase the strength of the violin and reduce the risk of cracks forming close to the edge of the violin. The purfling 41 may take a number of configurations but is defined by an inner purfling line 45 and outer purfling line 47 (as shown in FIG. 11). The area of the backplate 43 inside the inner purfling line is the sound-critical backplate area 49, where contact by a shoulder rest and its gripping members should be avoided in order to minimize the impact on sound quality of the instrument. The purfling 41 is formed in a channel in the backplate 43 (and top plate 51) substantially in line with the linings 53 (in particular, the inside purfling line 45 is substantially in line with the inner edge of the lining 53) provided to give structural stability to the juncture of backplate 43 and rib 55 and top plate 51 and rib 55, as can be seen in FIG. 12, which is a cross-sectional view along line A-A of FIG. 10. Since the area from the edge portion 57 to the inner purfling line 45 of the backplate 43 is reinforced by the lining and the purfling to provide structural integrity, it is acceptable to attach a shoulder rest to this area without negatively impacting the sound provided the gripping members 27 do not contact the sound-critical backplate area 49.

Figure 8:
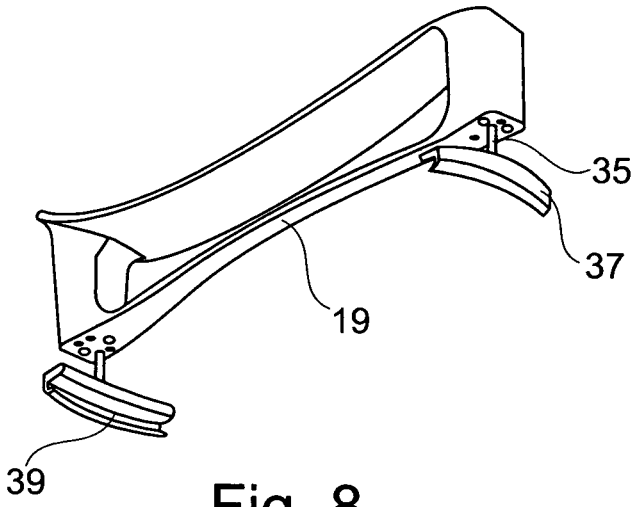
FIG. 8 shows a perspective view of the shoulder rest and gripping members of FIGS. 6 and 7.

The shoulder rests shown in earlier Figures, and in particular the gripping members 27 in FIGS. 6, 7 and 8, are configured such that the channel 29 (FIGS. 6 and 7) engages with the edge portion 57 of the backplate 43 of a violin 18 (FIG. 12) and the backplate contacting surface 39 (FIG. 8) can make contact only with the area of the backplate up to the inner purfling line 45 (FIGS. 11 and 12) and not inside that line. The configuration of shoulder rest 1 according to the invention having a cross-member 19 to minimize splay of gripping members 11, 27 (see FIGS. 2-8) allows gripping members with a reduced width b (FIG. 7) without increasing the risk that the shoulder rest 1 will disengage during use.

Figure 13:
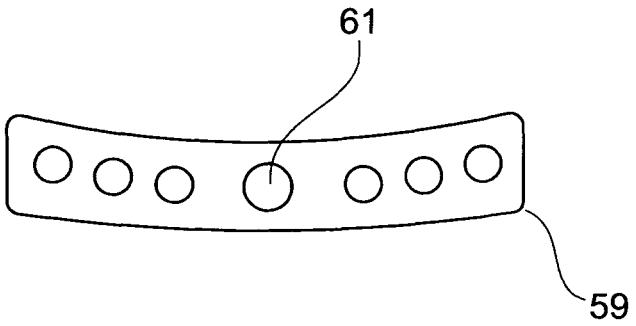
FIG. 13 is a plan view of a structural core element of a gripping member according to an embodiment of the present invention.
Figure 14:
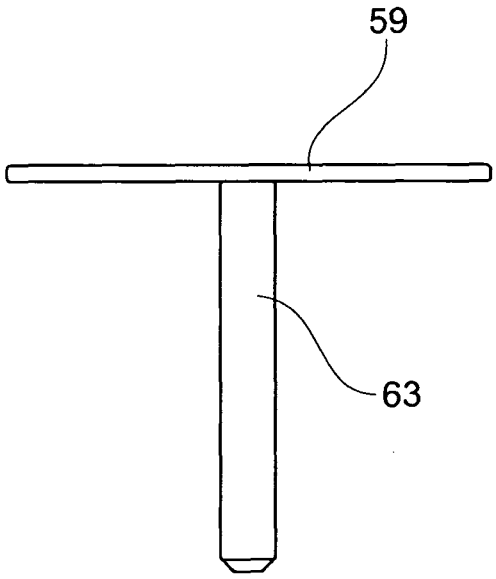
FIG. 14 is a side elevation of the structural core element of FIG. 13 provided with a connecting stem.

FIG. 13 shows a structural core element 59 for a gripping member 27 provided with a stem-receiving aperture 61 (optionally threaded). The diameter of the stem-receiving aperture 61 is preferably about 3 or 4 mm. Core element 59 is also provided with a plurality of weight-reducing apertures 63. FIG. 14 shows a side aspect of core element 59 with a stem 63 fitted (either cast or fitted to an aperture 61).

The invention has been described with reference to a preferred embodiment. However, it will be appreciated that variations and modifications can be effected by a person of ordinary skill in the art without departing from the scope of the invention.

The invention claimed is:

1. A shoulder rest for a violin or viola said shoulder rest comprising a longitudinal rest member having a first surface adapted for resting against the shoulder of a user and a second surface on the opposing side of said rest member from the first surface and projecting from said second surface at positions separated along the longitudinal axis of said rest member first and second support members themselves attached to first and second gripping members for clamping said shoulder rest to a violin or viola, the shoulder rest characterized in that a longitudinal cross-member is provided adjacent or displaced from the second surface of said rest member, which longitudinal cross-member and first and second support members together form an undercarriage to the rest member and together with the rest member form a substantially rigid box section, which longitudinal cross-member is sufficiently stretch resistant in its longitudinal direction and attached to the support members, whereby on application of pressure to the first surface of the rest member splay of the gripping members is inhibited thereby reducing the likelihood or incidence of disengagement of the shoulder rest from the instrument.

2. A shoulder rest according to claim 1, wherein the cross-member attaches to the support members between the gripping members and the rest member.

3. A shoulder rest according to claim 2, wherein the rest member, cross-member and support members together form a one-piece box section shoulder rest element.

4. A shoulder rest according to claim 2, wherein the rest member is detachably attached to the support members.

5. A shoulder rest according to claim 4, wherein the support members further comprise detachable spacer elements between the cross-member and the rest member.

6. A shoulder rest according to claim 1, which is for a violin or viola having a backplate and a purfling formed therein, wherein at least one of the first and second gripping members being characterised in that, in use, it does not contact the portion of the backplate inside the purfling line.

7. A shoulder rest according to claim 1, which is for a violin or viola having a backplate and an outer and an inner purfling line formed therein, wherein at least one of the first and second gripping members comprises a body having a backplate-engageable surface and one or more edge engagement appendages, characterized in that when an edge engagement appendage is fully engaged with an edge of a viola or violin, the backplate engageable surface of the body extends no more than 6 mm from the outside edge of the instrument and/or extends no further from the outside edge of the instrument than the inner purfling line.

8. A shoulder rest according to claim 1, wherein at least one of the first and second gripping members comprises a structural core element for providing structural integrity thereto, the structural core element being a planar element having a threaded aperture formed therein for receipt of a threaded stem for fixing a gripping member to a shoulder rest, or having cast thereon a stem, characterized in that the planar width of the core element is no more than 6 mm.

* * * * *